US008532530B2

(12) United States Patent
Nishida et al.

(10) Patent No.: US 8,532,530 B2
(45) Date of Patent: Sep. 10, 2013

(54) FIXING DEVICE FOR FIXING ON A RECORDING MATERIAL A TONER IMAGE FORMED ON THE RECORDING MATERIAL INCLUDING A FIXING ROLLER AND HEATING AND PRESSING MEMBERS

(75) Inventors: Satoshi Nishida, Numazu (JP); Kenichi Ogawa, Kawasaki (JP); Masashi Tanaka, Susono (JP); Shuichi Tetsuno, Numazu (JP); Shogo Kan, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 13/053,572

(22) Filed: Mar. 22, 2011

(65) Prior Publication Data

US 2011/0236084 A1 Sep. 29, 2011

(30) Foreign Application Priority Data

Mar. 26, 2010 (JP) ..... 2010-071466

(51) Int. Cl.
*G03G 21/00* (2006.01)

(52) U.S. Cl.
USPC ..... 399/124; 399/328; 399/322; 399/21

(58) Field of Classification Search
USPC ..... 399/328, 124, 21, 322
See application file for complete search history.

(56) References Cited

U.S. PATENT DOCUMENTS

| | | | | |
|---|---|---|---|---|
| 6,615,017 | B2 * | 9/2003 | Tanaka | 399/322 |
| 6,876,832 | B2 * | 4/2005 | Pirwitz et al. | 399/327 |
| 7,053,345 | B2 * | 5/2006 | Fukushi et al. | 219/619 |
| 7,203,438 | B2 | 4/2007 | Omata et al. | |
| 7,398,044 | B2 * | 7/2008 | Masuda et al. | 399/322 |
| 7,519,320 | B2 | 4/2009 | Aoki et al. | |
| 7,650,105 | B2 | 1/2010 | Ogawa et al. | |
| 7,702,249 | B2 | 4/2010 | Nishida | |
| 7,734,241 | B2 | 6/2010 | Nishida et al. | |
| 7,787,792 | B2 | 8/2010 | Nishida | |
| 2006/0165437 | A1 * | 7/2006 | Ito et al. | 399/122 |
| 2009/0080952 | A1 * | 3/2009 | Lucas et al. | 399/322 |
| 2010/0135706 | A1 | 6/2010 | Miki et al. | |
| 2010/0260523 | A1 | 10/2010 | Nishida et al. | |
| 2011/0082260 | A1 | 4/2011 | Omata et al. | |

FOREIGN PATENT DOCUMENTS

| | | | |
|---|---|---|---|
| JP | 6-75491 | | 3/1994 |
| JP | 2002-123117 | | 4/2002 |
| JP | 2004-317788 | | 11/2004 |
| JP | 2004-333683 | | 11/2004 |
| JP | 2005-241922 | | 9/2005 |
| JP | 2007034201 | A * | 2/2007 |
| JP | 2008026362 | A * | 2/2008 |

* cited by examiner

*Primary Examiner* — G. M. Hyder
(74) *Attorney, Agent, or Firm* — Fitzpatrick, Cello, Harper & Scinto

(57) ABSTRACT

A fixing device fixes on a recording material a toner image formed on the recording material and includes a fixing roller, a heating member for heating the fixing roller in contact with an outer surface of the fixing roller, and a pressing member for forming a fixing nip between itself and the fixing roller. When the recording material which has been jammed so that its leading end passes through the fixing nip to reach a contact portion between the heating member and the fixing roller, a force for drawing the recording material upstream when nipped in the fixing nip is at least equal to the drawing force of the recording material, toward the upstream side with respect to the rotational direction of the fixing roller, nipped between the fixing roller in the rest state and the heating member.

3 Claims, 11 Drawing Sheets

| STUDY | HEATER PRESSURE (kgf) | PRESSING ROLLER PRESSURE (kgf) | HEATING NIP DRAWING FORCE F2 (kgf) | FIXING NIP DRAWING FORCE F1 (kgf) | JAM CLEARANCE | |
|---|---|---|---|---|---|---|
| STUDY 1 | 20 | 10 | 5.0 | 2.5 | × | FIXING ROLLER SURFACE LAYER IS BROKEN AND PAPER IS BROKEN AND REMAINS |
| STUDY 2 | 18 | 12 | 4.6 | 2.8 | × | FIXING ROLLER SURFACE LAYER IS BROKEN AND PAPER IS BROKEN AND REMAINS |
| STUDY 3 | 16 | 14 | 4.2 | 3.1 | × | FIXING ROLLER SURFACE LAYER IS BROKEN |
| STUDY 4 | 14 | 16 | 3.8 | 3.4 | × | FIXING ROLLER SURFACE LAYER IS BROKEN |
| STUDY 5 | 13 | 17.5 | 3.6 | 3.6 | ○ | |
| STUDY 6 | 12 | 18 | 3.4 | 3.7 | ○ | |
| STUDY 7 | 10 | 20 | 3.0 | 4.0 | ○ | |

Fig. 7

FIXING DEVICE FOR FIXING ON A RECORDING MATERIAL A TONER IMAGE FORMED ON THE RECORDING MATERIAL INCLUDING A FIXING ROLLER AND HEATING AND PRESSING MEMBERS

FIELD OF THE INVENTION AND RELATED ART

The present invention relates to a fixing device to be mounted in an image forming apparatus, such as printer, a copying machine or a facsimile machine, using electrophotography or electrostatic recording technology.

A heat fixing device as a conventional heat fixing means in the image forming apparatus using an electrophotographic process fixes, on a recording material, an unfixed image (toner image) formed on the recording material by an image forming means, such as an electrophotographic process means. As a fixing type, a heating-roller type using a known halogen heater as a heat source or a film-heating type using a ceramic heater as the heat source has been employed.

Further, in recent years, a fixing device for heating a fixing roller, provided with no heat source therein, from an outer peripheral surface of the fixing roller by bringing a heating member into surface contact with the outer peripheral surface of the fixing roller to form in a heating press-contact portion has been proposed. For example, a heating device (fixing device) for heating only the outer peripheral surface of the fixing roller with the heating member by bringing the heating member, such as the ceramic heater or a small-diameter heat roller, into contact with the outer peripheral surface of the fixing roller has been proposed (e.g., Japanese Laid-Open Patent Application (JP-A) Hei 6-75491, JP-A 2004-317788 and JP-A 2002-123117).

These fixing devices are, similar to the heat-roller-type fixing device, excellent in stability and durability. Further, the fixing roller is externally heated by the heating member having a low thermal capacity and therefore, the surface of the fixing roller can be abruptly increased in temperature, so that the warm-up time is reduced compared with the heat-roller-type fixing device.

In a fixing device in which a recording material P is guided into a fixing nip and is heated while being nipped and conveyed, in the case where the recording material P is, e.g., thin paper with low rigidity, the melted toner image on the recording material acts as an adhesive material, so that the recording material is wound about the fixing member in some cases. In the case where a paper jam (jamming), such as winding of the recording material, occurs, a user removes the wound recording material by grasping a trailing end portion of the recording material P at which the recording material P is not wound about the roller and then by pulling out the recording material nipped in the fixing nip (jam clearance).

However, as shown in FIG. 13, in a constitution in which a film 16 is contacted to an outer peripheral surface of a fixing roller 30 and a contact portion N2 other than a fixing nip N1 is provided, the wound recording material is moved from the fixing nip N1 and then reaches the contact portion N2 other than the fixing nip N1 in some cases.

The user intends to pull out from the contact portion N2 in a direction, indicated by an arrow A as shown in (a) of FIG. 13, the recording material P by holding one end of the recording material P but the recording material P is nipped at a plurality of portions consisting of the fixing nip N1 and the contact portion N2, so that a brake is applied to the recording material P at the portions N1 and N2 in different directions with different forces.

When the recording material P is not moved at the contact portion N2 but is pulled out from only the fixing nip N1, the recording material P is placed in a state in which the fixing roller 30 is tightened as shown in (b) of FIG. 13, so that an excessive load is exerted on the fixing roller 30 in some cases. Further, when the recording material P was broken (torn), the fixing device was placed in some cases in a state in which it was difficult to remove the recording material P.

SUMMARY OF THE INVENTION

The present invention has been accomplished in view of the above problems. A principal object of the present invention is to provide a fixing device capable of easily removing a jammed recording material even when a winding jam, such that the recording material is wound about a fixing roller, occurs.

According to an aspect of the present invention, there is provided a fixing device for fixing on a recording material a toner image formed on the recording material, the fixing device comprising:

a fixing roller;

a heating member for heating the fixing roller in contact with a surface of the fixing roller; and a pressing member for forming a fixing nip between itself and the fixing roller, wherein the recording material on which the toner image is formed is subjected to fixing by being nipped and conveyed in the fixing nip, and wherein when the recording material which has been jammed is removed by pulling a trailing end of the recording material in a winding jam state in which a leading end of the recording material has passed through the fixing nip to reach a contact portion between the heating member and the fixing roller, a drawing force F1 for drawing the recording material, toward an upstream side with respect to a rotational direction of the fixing roller, nipped in the fixing nip between the fixing roller in a rest state and the pressing member and a drawing force F2 for drawing the recording material, toward the upstream side with respect to the rotational direction of the fixing roller, nipped between the fixing roller in the rest state and the heating member are set so that the drawing force F2 is not more than the drawing force F1, so as to prevent the fixing roller from being tightened by the recording material.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a table showing a result of confirmation of effects in First Embodiment.

Figure 13:
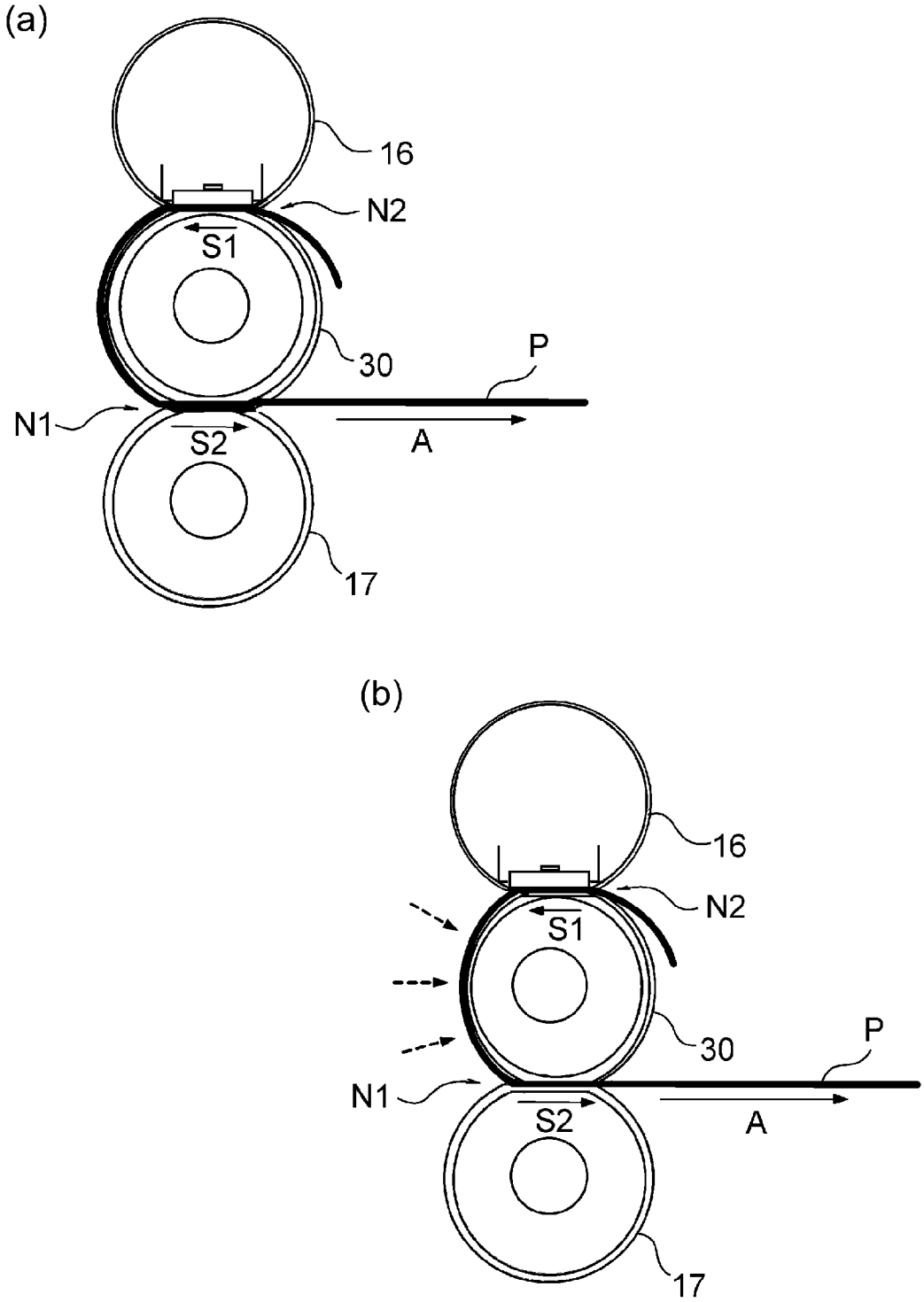

Parts (a) and (b) of FIG. 13 are schematic sectional views for illustrating a winding jam clearance method with respect to a fixing member.

DESCRIPTION OF THE PREFERRED EMBODIMENTS

Hereinbelow, embodiments for carrying out the present invention will be described with reference to the drawings.

First Embodiment

Image Forming Portion

Figure 1:
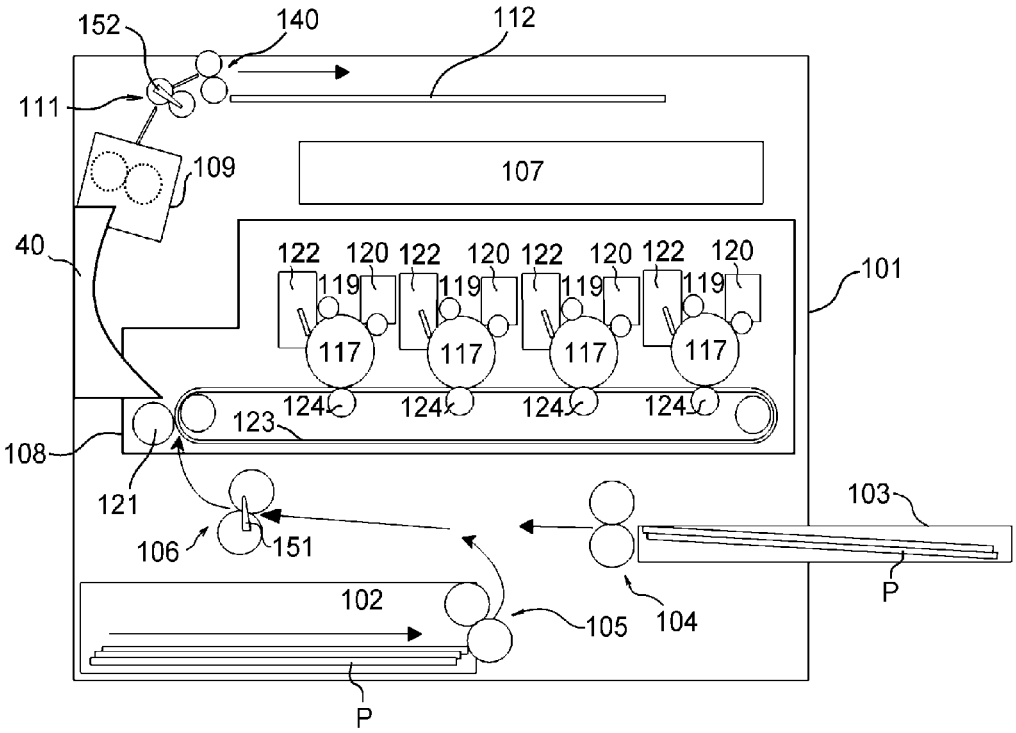
FIG. 1 is a schematic illustration of an image forming apparatus.

FIG. 1 is a schematic illustration of an image forming apparatus using an electrophotographic process in First Embodiment of the present invention and shows the case of, e.g., a laser (beam) printer.

The structure and operation of the image forming apparatus will be described below. A laser printer main assembly 101 as the image forming apparatus includes a sheet feeding cassette 102 for accommodating a recording material P, and the sheet feeding cassette 102 is provided with feeding rollers 105 for feeding the recording material P. Further, the main assembly 101 also includes an externally insertable sheet feeding tray 103 which is provided with feeding rollers 104 for feeding the recording material P.

On a downstream side of the feeding rollers 105, a registration roller pair 106 for synchronization-conveying the recording material P, and a top sensor 151 are provided. A signal detected by the top sensor 151 is transmitted to a CPU 23 described later, so that the CPU 23 detects passing of the recording material P at a pressure of the registration roller pair 106.

Further, downstream of the registration roller pair 106, an image forming portion 108 for forming a toner image on the recording material P on the basis of laser light from a laser scanner portion 107 is provided. That is, in the laser printer in this embodiment, an image forming means is constituted by this laser scanner portion 107 and the image forming portion 108.

Further, downstream of the image forming portion 108, a fixing device 109 as a heating device for heat-fixing the toner image formed on the recording material P is provided. Downstream of the fixing device 109, a first sheet discharging roller pair 111, a second sheet discharging roller pair 140 and a stacking tray 112 for stacking sheets of the recording material P on which recording has been completed are provided.

The image forming portion 108 is constituted by members necessary for the electrophotographic process, such as a photosensitive drum 117, a charging roller 119, a developing device 120, a primary transfer roller 124, a secondary transfer roller 121, a cleaner 122, an intermediary transfer member 123, and the like.

(Fixing Device)

Figure 2:
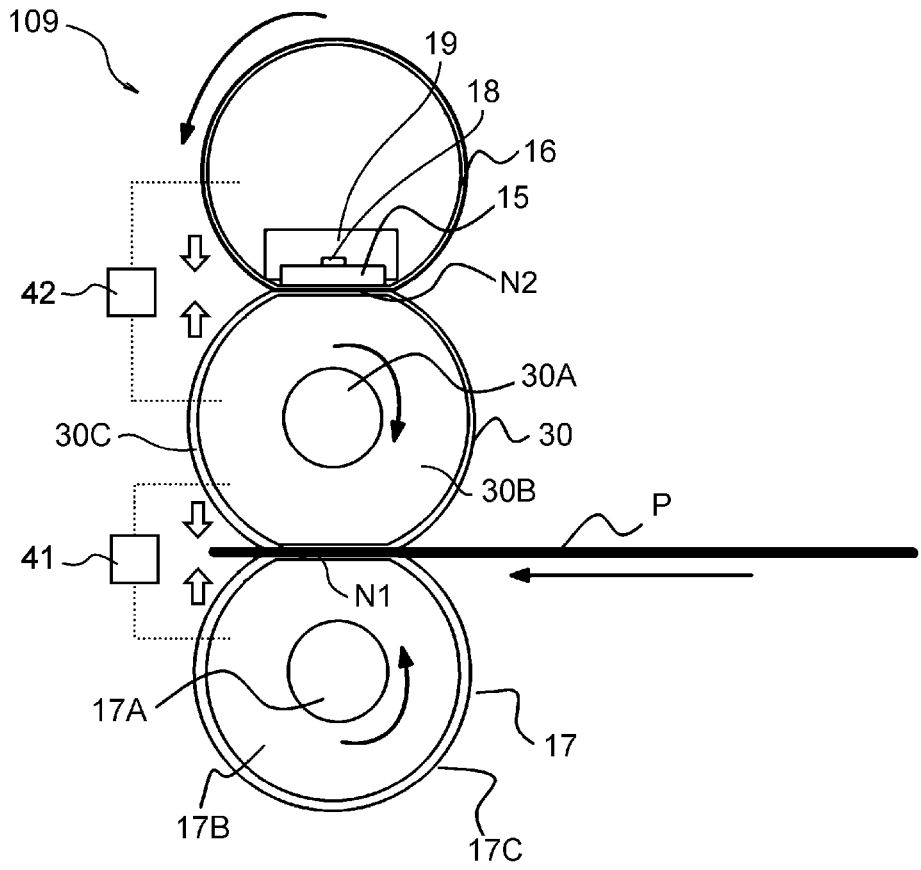
FIG. 2 is a schematic sectional view showing a schematic structure of a fixing device in First Embodiment.

Next, the fixing device 109 provided in the printer 1 will be described with reference to FIG. 2. Incidentally, FIG. 2 is a schematic sectional view showing a schematic structure of the fixing device 109 in First Embodiment.

The fixing device 109 includes a rotatable fixing roller 30. On the fixing roller 30, an endless belt-like film 16 for forming a contact portion N2 in press-contact with the outer peripheral surface of the fixing roller 30 is provided so as to contact the fixing roller 30. Inside the film 16, a ceramic heater 15 and a thermistor temperature sensor (hereinafter referred to as a thermistor) 18 are provided. Under the fixing roller 30 and at an opposing position through the recording material P, a rotatable pressing roller 17, which is a pressing member and is formed in a cylindrical or substantially cylindrical shape, is provided.

The fixing roller 30 and the pressing roller 17 are press-contacted by a first pressing mechanism 41, such as a known spring, to form a fixing nip N1. Further, the fixing roller 30 and the film 16 contacted to the ceramic heater 15 are press-contacted by a second pressing mechanism 42, such as a known spring, to form a contact portion N2.

As shown in FIG. 1, on the downstream side of the fixing nip N1 of the fixing device 109, the first sheet discharging roller pair 111 and a sheet discharging sensor 152 are provided. The sheet discharging sensor 152 is connected to the CPU 23. For this reason, passing of the recording material P can be detected by the sensor 152.

(Parts of Fixing Device)

Figure 3:
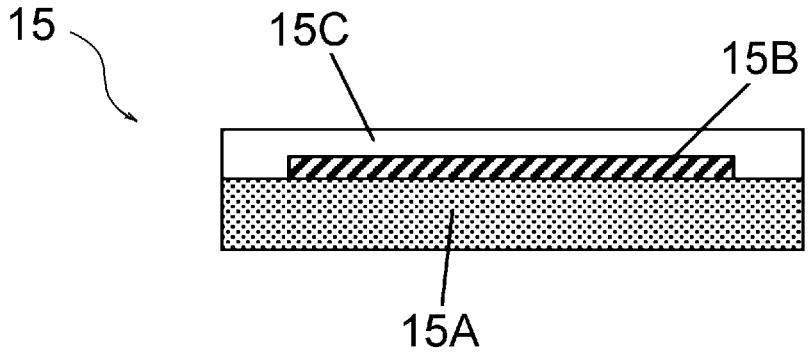
FIG. 3 is a partial perspective view showing a schematic structure of a ceramic heater.

The ceramic heater 15 provided in the fixing device 109 is supported by a holder 19 attached to the main assembly of the fixing device 109. The ceramic heater 15 will be described. FIG. 3 is a partial perspective view showing a schematic structure of the ceramic heater 15.

As shown in FIG. 3, the ceramic heater 15 is constituted by a substrate 15A, a heat generating resistor 15B and a protective layer 15C.

The substrate 15A is principally formed of a ceramic, such as alumina or aluminum nitride, in a thin plate shape. The heat generating resistor 15B is principally formed of silver, palladium or the like on one surface of the substrate 15A. On the other surface of the substrate 15A, the thermistor 18 is provided in contact with the substrate 15A. Further, the protective layer 15C is principally formed of glass or a heat resistant resin material, such as fluorine-containing resin material or polyimide, and is coated so as to protect the surface, at which the heat generating resistor 15B is provided, from sliding contact with the film 16 or the like.

Figure 4:
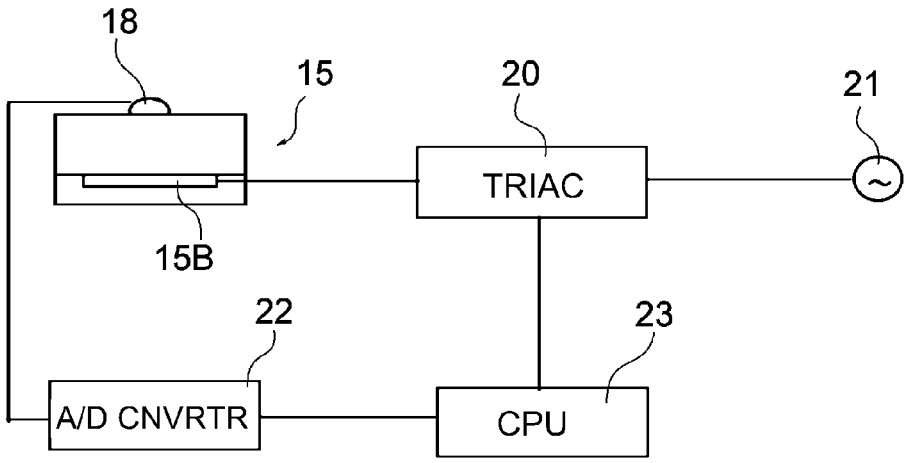
FIG. 4 is a block diagram of a connection relationship among the ceramic heater and its peripheral means.

FIG. 4 is a block diagram showing a connection relationship among the ceramic heater 15 and its peripheral means.

As shown in FIG. 4, the heat generating resistor 15B constituting the ceramic heater 15 is supplied with electric power from a commercial power source 21 via a triac 20. Therefore, by heat generation of the heat generating resistor 15B, which has been supplied with electric power from the commercial power source 21, heating by the ceramic heater 15 is performed. Further, a signal from the thermistor 18 is transmitted to the CPU 23 via an A/D conversion circuit 22.

The film 16 provided in the fixing device 109 is, as shown in FIG. 2, formed in an inner circumferential length which is longer than an outer circumferential length of the holder 19 by a predetermined length. For this reason, the film 16 is externally engaged with the holder 19 with no tension and is guided in a predetermined direction by the holder 19 while being moved by the rotation of the fixing roller 30. Incidentally, the fixing roller 30 is rotated by a driving mechanism (not shown) provided outside the main body of the fixing device 109.

Further, the film 16 employs a two-layer structure such that an endless belt-like member principally formed of PFA is coated on the outer peripheral surface of an endless belt-like member principally formed of polyimide.

The fixing roller 30 includes a metal core 30A, an elastic layer 30B and a parting layer 30C. The metal core 30A is a rotatable cylindrical member which is formed, in a cylindrical or substantially cylindrical shape, of iron, SUS, aluminum or the like. The elastic layer 30B is formed, on the outer peripheral surface of the metal core 30A, principally of a silicone rubber or the like. Further, the parting layer 30C is formed as an outermost layer of the fixing roller 30. The parting layer 30C is principally formed of PTFE, PFA, FEP or the like. The thus-constituted fixing roller 30 is rotationally driven by receiving a driving force from a driving mechanism to an end portion of the metal core 30A with respect to a roller axis direction thereof.

The pressing roller 17 as the pressing member includes a metal core 17A, an elastic layer 17B and a parting layer 17C. The metal core 17A is a rotatable cylindrical member which is formed, in a cylindrical or substantially cylindrical shape, principally of aluminum or the like. The elastic layer 17B is formed, on the outer peripheral surface of the metal core 17A, principally of a silicone rubber or the like. Further, the parting layer 17C is formed as an outermost layer of the pressing roller 17 and is principally formed of PTFE, PFA, FEP or the like. The thus-constituted fixing roller 17 is rotated by the rotation of the fixing roller 30 which has been rotationally driven.

(Measuring Method of Drawing Force F)

Figure 5:
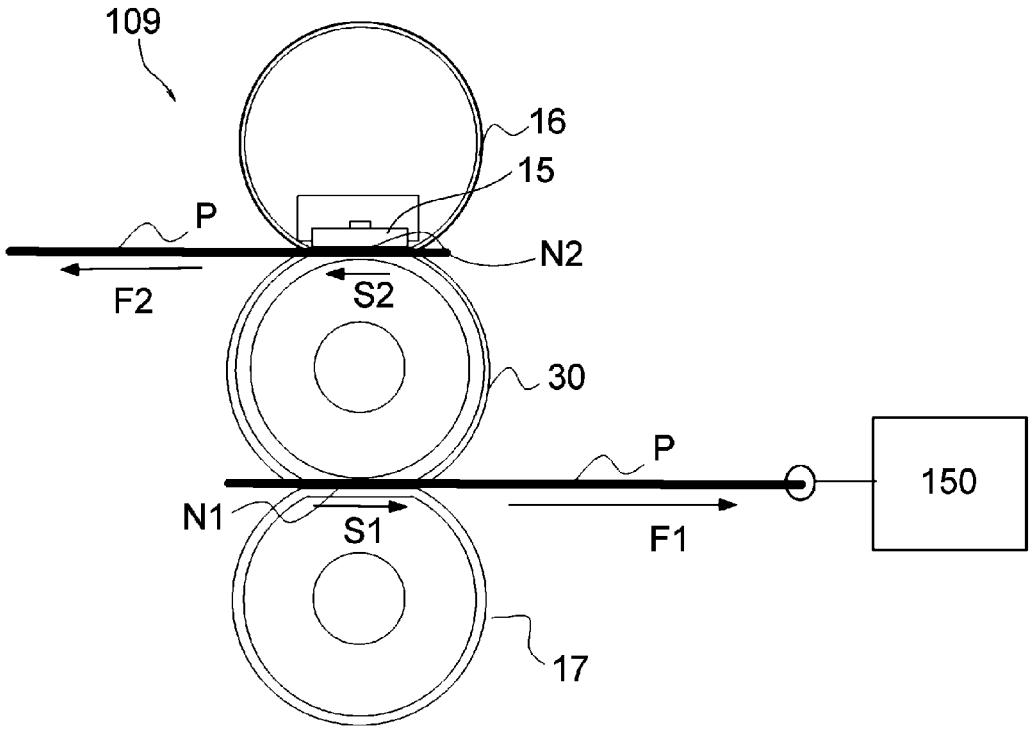
FIG. 5 is a schematic view for illustrating a measuring method of drawing forces (pulling-out forces).

A measuring method of a fixing device (pulling-out force) F is as follows. FIG. 5 is a schematic view for illustrating the measuring method of the drawing force F.

As shown in FIG. 5, in the case where a first drawing force F1 in the fixing nip N1 is measured, the recording material P is nipped in the fixing nip N1 at a position of 50 mm from a leading end thereof and then a wire bonded to a longitudinal central portion of a trailing end of the recording material P is drawn (pulled out). Then, a force at the time when the recording material P is drawn in a tangential direction of the outer circumferential surface of the fixing roller 30 (with respect to the fixing nip N1) is measured by a digital force gauge 150. Here, as the recording material P, LTR (letter)-sized paper ("Xerox 4200 copy paper", basis weight: 85 g/$m^2$) was used. As the digital force gauge 150, a digital force gauge ("MODEL FGN 10", mfd. by NIDEC-SIMPO Corp.) was used. A second drawing force F2 at the contact portion N2 is also measured similarly by drawing the recording material P from the contact portion N2.

In the fixing device 109 in this embodiment, a relationship between these drawing forces F1 and F2 is set as follows. That is, the first drawing force F1 necessary to draw the recording material P from the fixing nip N1 is set so as to be not less than the second drawing force F2 necessary to draw the recording material P from the contact portion N2 (F1≧F2).

The drawing forces F1 and F2 can be adjusted by changing the pressure of the film on the fixing roller 30, the pressure of the pressing roller 17 on the fixing roller 30, and the materials and surface properties of the surface layers of the film 16 and the pressing roller 17.

For example, the pressure of the film 16 on the fixing roller 30 may be equal to or less than the pressure of the pressing roller 17 on the fixing roller 30.

Further, in general, of the same fluorine-containing resin material, PTFE is excellent in its sliding property compared with PFA, so that the drawing force can be made small. For this reason, the surface of the film 16 may also be coated with a blend resin material of PTFE and PFA, and the surface of the pressing roller 17 may also be coated with the PFA resin material.

(Operation)

Operations of the fixing device and the image forming apparatus will be described with reference to FIG. 1.

The main assembly 101 receives a print signal by an unshown controller. Then, the fixing roller 30 is driven and rotated, so that the film 16 and the pressing roller 17 are also rotated together by the rotation of the fixing roller 30.

The electric power supply to the ceramic heater 15 is started, the temperature of the ceramic heater 15 detected by the thermistor 18 and is controlled so that the temperature reaches a predetermined target temperature.

The surface of the fixing roller 30 is heated by the ceramic heater 15 through the film 16 to be increased in temperature up to a predetermined temperature. The recording material P fed from the sheet feeding cassette 102 by the feeding rollers 105 with predetermined timing is sent to the image forming portion 108 by the registration roller pair 106.

When the leading end of the recording material P reaches the registration roller pair 106, the top sensor 151 disposed at the registration-roller position detects passing of the recording material P. The recording material P on which an unfixed toner image has been transferred is guided into the fixing nip N1 of the fixing device 109.

The recording material P guided into the fixing nip N1 is semi-permanently fixed on the recording material P by melting the unfixed toner image while being nip-conveyed between the pressing roller 17 and the fixing roller 30 which has been heated by the ceramic heater 15 through the film 16.

The recording material P fixed in the fixing nip N1 passes through the first sheet discharging roller pair 111 and the second sheet discharging roller pair 140, thus being discharged on the stacking tray 112.

When the leading end of the recording material P reaches the first sheet discharging roller pair 111, the sheet discharging sensor 152 disposed at the charging-roller-pair position detects the passing of the recording material P.

In the case where a series of printing operations are normally performed, after a lapse of a predetermined time (a movement time calculated from a distance between the top sensor 151 and the sheet discharging sensor 152) from the detection of the leading end of the recording material P by the top sensor 151, the sheet discharging sensor 152 detects the leading end of the recording material P. Similarly, after a lapse of a predetermined time from the detection of the trailing end of the recording material P, the sheet discharging sensor 152 detects the trailing end of the recording material P.

In the case where the sheet discharging sensor 152 cannot detect the leading end of the recording material P after the lapse of the predetermined time from the detection of the leading end of the recording material P by the top sensor 151, it is determined that the recording material P has caused jamming such as winding of the recording material P about the fixing roller 30 or a paper jam. In this case, the image formation operation is stopped, and the driving of the fixing roller 30 and the first sheet discharging roller pair 111 and the electric power supply to the ceramic heater 15 are stopped.

Here, a winding jam will be described.

At the surface of the fixing roller 30, the surface layer of the fluorine-containing resin material with a good parting property is formed. Further, when the toner is melted in the fixing nip N1, wax contained in the toner bleeds out, thus assisting the separation of the recording material P from the fixing roller 30. Generally, based on this force, the recording material P is separated from the fixing roller 30 after passing through the fixing nip N1 by rigidity of the recording material P, thus being discharged in safety.

However, when the toner is excessively melted in the fixing nip N1, the surface tension of the toner becomes small and the toner is liable to adhere, so that adherence of the toner to the surface layer of the fixing roller 30 is increased. Further, on the other hand, when the toner is not melted sufficiently, the wax does not sufficiently bleed out. In the case where the unfixed toner image is intended to be fixed at an improper temperature, the adherence between the toner on the recording material P and the surface of the fixing roller 30 exceeds the degree of the rigidity of the recording material P in some cases. In this case, the recording material P is rotated together with the fixing roller 30 while being adhered to the fixing roller 30 to enter the contact portion N2, so that there is a possibility of an occurrence of the winding jam.

The temperature and heat quantity of the surface of the fixing roller 30 suitable for melt-fixing the toner image on the recording material P to be separated from the fixing roller in safety are largely changed depending on a basis weight of the recording material P, i.e., thermal capacity. Therefore, it is difficult to fix various recording materials, ranging from thin paper with the basis weight of about 50 $g/m^2$ to thick paper with the basis weight of about 200 $g/m^2$, at the same temperature.

It is difficult to select a fixing mode with a proper fixing temperature automatically or by the user with respect to the various recording materials which can be used by the user. Therefore, it is difficult to completely prevent the winding jam about the fixing roller 30.

It is desirable that the jam is determined to occur before the leading end of the recording material P which has been wound about the fixing roller 30 reaches the contact portion N2 and then the drive of the fixing roller 30 is stopped. However, there arises the following problem in this case, so that it is actually difficult to completely prevent this winding jam.

Figure 6:
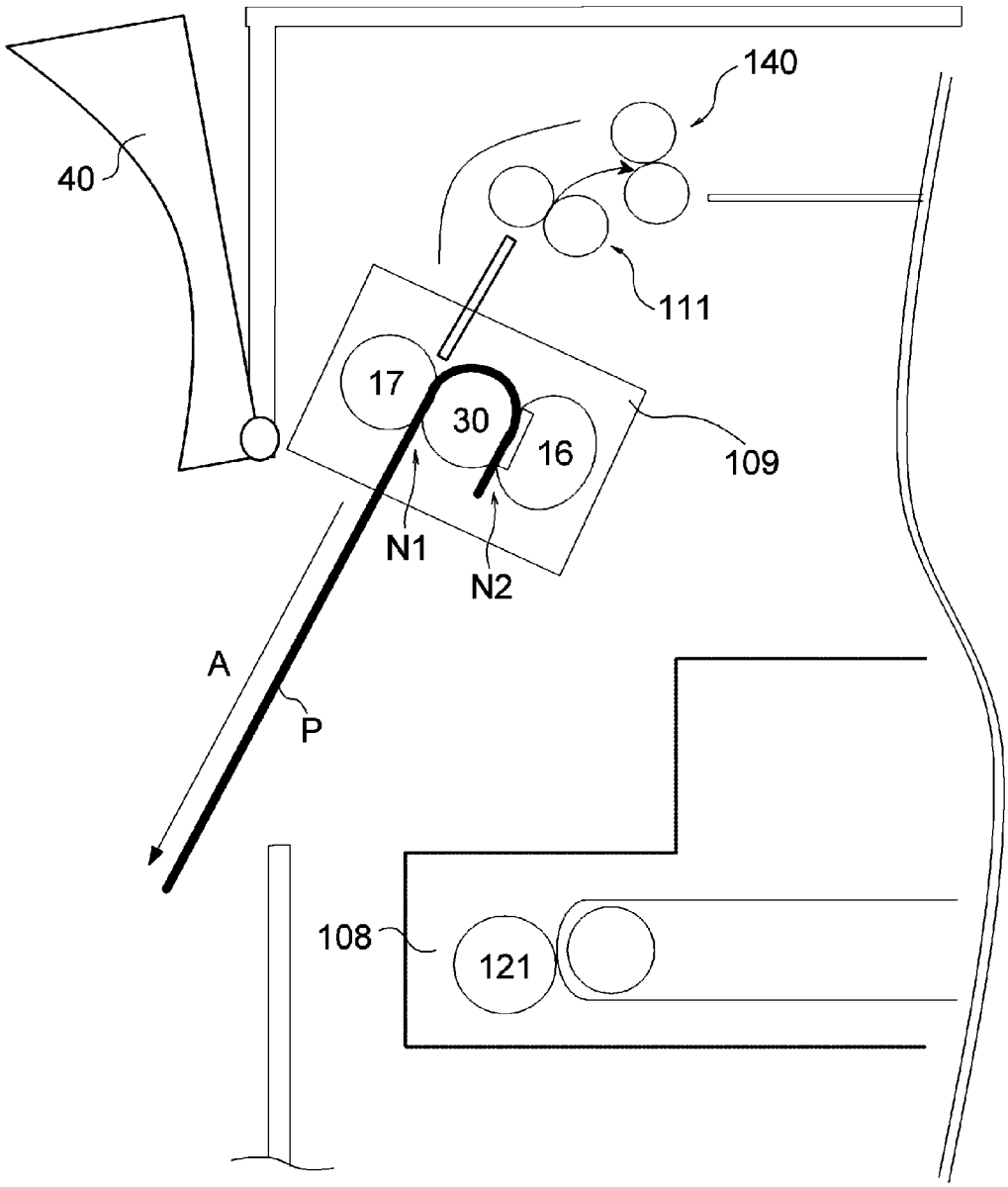
FIG. 6 is a schematic sectional view for illustrating a jam clearance method in the image forming apparatus.

First, the distance from the fixing nip N1 to the sheet discharging sensor 152 is required to be shorter than that from the fixing nip N1 to the contact portion N2, but there is a possibility that the sheet discharging sensor 152 does not operate normally as a result of the heat generated by the fixing roller 30, so that the sheet discharging sensor 152 cannot be disposed so close to the fixing nip N1. Further, depending on detection accuracy of the top sensor 151 and the sheet discharging sensor 152, it takes much time until the recording material P is determined to cause the jam. Further, by idling of a gear or a motor, it takes much time from the intention to stop the driving of the fixing roller 30 until the fixing roller 30 is actually stopped. For these reasons, in this embodiment jam clearance is performed in the following manner. FIG. 6 is a schematic sectional view for illustrating a jam-clearance method in the image forming apparatus.

In the case where the jam has occurred, the CPU 23 notifies the user of the occurrence of the jam by, e.g., turning on a warning LED of the jam occurrence. In this case, as shown in FIG. 6, the user opens a jam clearance door 40 provided between the image forming portion 10*f* and the fixing device 109 and draws the recording material P by pulling the trailing end of the recording material P in an outward direction (indicated by an arrow A in FIG. 6). Thus, the jam clearance is performed.

In this embodiment, the first and second drawing forces F1 and F2, which are the forces for drawing the recording material P from the fixing nip N1 and the contact portion N2, respectively, are set to satisfy: F1≧F2.

In this constitution, even when the winding of the recording material P about the fixing roller 30 has occurred and the recording material P has reached the contact portion N2, by the first drawing force F1, the recording material P can be pulled out from not only the fixing nip N1 but also the contact portion N2. Further, the recording material P can be drawn while rotating the fixing roller 30 by the pulling-out operation of the recording material P without being deviated from the surface of the fixing roller 30 in the fixing nip N1.

Further, when the user draws the recording material P, and thus the recording material P is gradually pulled out, as shown in FIG. 5, the speed S2 at which the recording material P is gradually pulled out from the contact portion N2 is not more than the speed S1 at which the recording material P is gradually pulled out from the fixing nip N1.

In contrast with this embodiment, in the case where the drawing forces F1 and F2 satisfy: F1<F2, the recording material P can be drawn from the fixing nip N1 by the drawing force F1 but cannot be drawn from the contact portion N2 by the drawing force F2. In this case, when the recording material P does not slip on the fixing roller 30 in the fixing nip N1, the fixing roller 30 is to be rotated by being pulled by the recording material P. However, at the contact portion N1, the brake is applied. As a result, there is a possibility that wrinkles occur on the surface of the fixing roller 30 or that an excessive load is exerted on the elastic layer 30B. Further, the elastic layer 30B is elastically deformed and the recording material P is drawn from only the fixing nip N1, so that the fixing roller 30 is tightened by the recording material P. Further, even when the recording material P has slipped on the fixing roller 30 in the fixing nip N1, the recording material P is drawn from only the fixing nip N1, so that the fixing roller 30 is tightened by the recording material P. When the fixing roller 30 is tightened by the recording material P, pressure is applied to the surface of the fixing roller 30 at the tightened portion, so that a force necessary for the jam clearance is increased. As the user draws the recording material P in an increasing distance, an increasing drawing force is generated, so that it is difficult to perform the jam clearance. Further, when the user intends to forcedly pull out the recording material P, there is a possibility that an overload is exerted on the tightened fixing roller 30. Further, when the recording material P is broken or torn, it becomes further difficult to perform the jam clearance.

(Effect)

The effect of the fixing device in this embodiment was confirmed through an experiment. First, a constitution of the fixing device used in the experiment in this embodiment will be described.

The ceramic heater 15 includes the substrate 15A formed of aluminum in a thickness of 1.0 mm and a width of 7.0 mm and includes the heat generating resistor 15B formed of silver and palladium in the thickness of 10 μm and the width of 4.0 mm. The resistor 15 is coated with a 60 μm-thick glass layer as the protective layer 15C. The film 16 includes a 30 μm-thick film base layer of SUS and a 20 μm-thick parting layer formed of PFA resin on the base layer.

The fixing roller 30 is prepared by forming a 3.0 mm-thick elastic layer 30B of a silicone rubber having a thermal conductivity of 0.2 W/m·K on the metal core 30A which is formed of aluminum and has an outer diameter of 14 mm and then by providing a 20 μm-thick parting layer 30C of the PFA resin as the outermost layer.

The pressing roller 17 is prepared by forming a 3.0 mm-thick elastic layer 17B of a silicone rubber having a thermal conductivity of 0.2 W/m·K on the metal core 17A which is formed of aluminum having an outer diameter of 14 mm and then by providing a 20 μm-thick parting layer 17C of the PFA resin as the outermost layer.

Each of the first drawing force F1 necessary to pull out the recording material P from the fixing nip N1 and the second drawing force necessary to pull out the recording material P from the contact portion N2 was measured. During the measurement, each of the pressure between the ceramic heater 15 and the fixing roller 30 and the pressure between the fixing roller 30 and the pressing roller 17 was changed. In each of resultant constitutions, a jam-clearance test was conducted.

The jam-clearance test was conducted in the following manner. The LTR-sized paper ("Xerox 4200 copy paper", basis weight: 75 g/m$^2$) was nipped in the fixing nip N1 and then nipped in the contact portion N2 while being wound about the fixing roller 30 so that the recording material P for the jam-clearance test was set so as to be protruded from the contact portion N2 by 10 mm. Then, the user held (grasps) the recording material P with one hand at a position of about 50 mm from the trailing end of the recording material P, which was then is pulled out in a straight line in the tangential direction of the outer circumferential surface of the fixing roller 30 from the fixing nip N1. This operation was performed 10 times.

As a result, the jam clearance was evaluated as "o" (Good) when there was of no problem, and was evaluated as "x" (No good) when there arose the problem in at least one pulling-out operation.

The result is shown in FIG. 7, which is a table showing the set pressure values, measured values of the drawing forces, and the evaluation results of the jam-clearance test.

As the result of the jam-clearance test, as shown in FIG. 7, in study 1 to study 4 in which F1<F2 was satisfied, the fixing roller 30 was tightened by the recording material P and thus it was difficult to draw the recording material P. When the recording material P was further pulled, the recording material P was broken (torn) and remained in a jam-clearance disable state. Further, in study 1 and study 2, the surface layer of the fixing roller 30 was broken. In study 5 to study 7 in which F1≧F2 was satisfied, it was possible to perform the jam clearance in safety without tightening the fixing roller 30 by the recording material P.

As described above, in this embodiment, in the heat-fixing device including the plurality of the press-contact portions, the relationship between the second drawing force F2 at the contact portion N2 and the first drawing force at the fixing nip N1 was F1≧F2. As a result, even in the case where the jam occurs in the fixing device 109, the fixing roller 30 was not tightened by the recording material P. For this reason, the wound recording material P could be easily removed and thus the fixing performance could be easily restored.

Second Embodiment

In this embodiment, a constitution including a pressure-reducing(releasing) mechanism for adjusting press-contact forces of members will be described. Constituent elements similar to those described above are represented by the same reference numerals or symbols and will be omitted from description.

In this embodiment, the relationship between the first drawing force F1 and the second fixing device F2 during a normal operation is not particularly limited, but a first pressing mechanism 41 and a second pressing mechanism 42 are used as a pressing mechanism including the pressure-reducing mechanism which may be a known mechanism for moving an end of the spring or the like in a pressure reducing (releasing) direction, for example.

The first pressing mechanism 41 and the second pressing mechanism 42 include the pressure-reducing mechanism which not only increases but also decreases the pressures to the fixing roller 30 and the pressing roller 17. For this reason, the first pressing mechanism 41 and the second pressing mechanism 42 can change the pressure to an increased-pressure side and a decreased-pressure side. The adjustment of the pressure is performed in accordance with instructions from the CPU 23.

By this constitution, in the case where a jam occurrence is detected, by the action of the first pressing mechanism 41 and the second pressing mechanism 42, a first pressure to be applied to the fixing nip N1 and a second pressure to be applied to the contact portion N2 can be weakened, respectively.

The first pressing mechanism 41 and the second pressing mechanism 42 are reduced in pressure at a stage in which the jam clearance is performed. Specifically, their pressures are reduced so that a first drawing force F1*b* necessary to pull out the recording material P from the fixing nip N1 and a second drawing force F2*b* necessary to pull out the recording material P from the contact portion N2 satisfy a relationship of F1*b*≧Fb2.

In the case where the winding jam of the recording material P occurs, the sensor detects the jam occurrence. Then, the CPU 23 stops the image formation operation and stops the driving of the fixing roller 30 and the sheet discharging roller pair 111 and electric power supply to the ceramic heater 15. Further, by the first pressing mechanism 41 and the second pressing mechanism 42, the pressure applied to the fixing nip N1 and the pressure applied to the contact portion N2 are weakened, respectively. As a result, based on the relationship between of F1*b*≧F2*b*, the recording material P can be easily pulled out.

Third Embodiment

Figure 8:
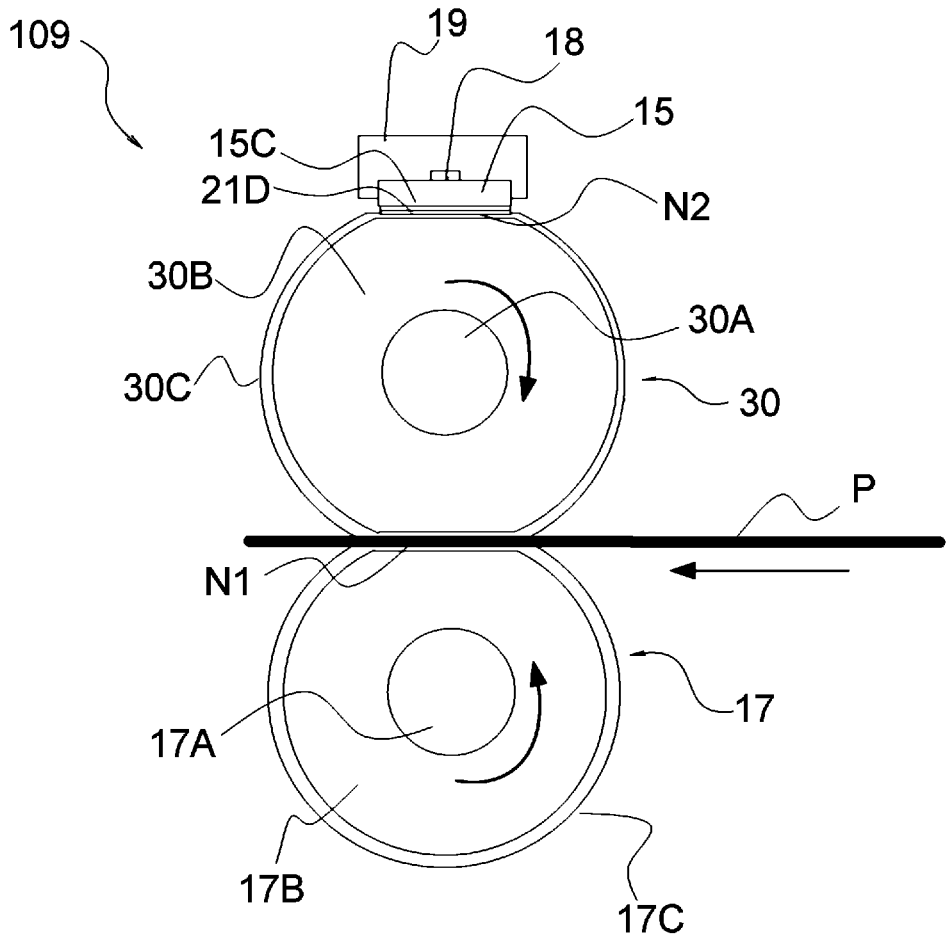
FIGS. 8 to 12 are schematic sectional views showing schematic structures of fixing devices in Third Embodiment to Seventh Embodiment, respectively.

In this embodiment, a constitution including a pressure-reducing mechanism for adjusting press-contact forces of members will be described. Constituent elements similar to those described above are represented by the same reference numerals or symbols and will be omitted from description. FIG. 8 is a schematic sectional view showing a schematic structure of a fixing device in Third Embodiment.

In this embodiment, different from First Embodiment, the film 16 is not externally engaged with the ceramic heater 15 but as shown in FIG. 8, the ceramic heater 15 is slidably contacted to the fixing roller 30 directly or via the protective member or the like to form the contact portion N2.

Specifically, on the protective layer 15C of the ceramic heater 15C, a sliding layer 21D (press-contact member) is formed for the purposes of enhancing the sliding property relative to the fixing roller 30 and of preventing the adherence of the toner. For example, the sliding layer 21D is formed of a material such as the fluorine-containing resin material with a good sliding property and parting property in the thickness from about 10 μm to about 30 μm. Or, on the heat-generating resistor layer, the protective layer of the fluorine-containing resin material or the like is directly formed in the thickness from about 10 μm to about 100 μm so as to be configured to perform the functions as an insulating protective layer for the heat generating member and the sliding layer.

Further, the contact portion N2 may also be formed by providing a protective sheet on the fixing roller 30 side (front surface side) of the ceramic heater 15 and by interposing the protective sheet between the ceramic heater 15 and the fixing roller 30.

The protective sheet is formed with a metal member such as stainless steel (SUS), nickel (Ni), titanium (Ti) or copper (Cu). Or, the protective sheet may also be a sheet-like protective member formed on a sheet base layer on the fixing roller side. In this case, the sheet base layer is formed in the thickness of 10-30 μm by mixing a large amount of high heat-resistant filler, such as powders of metal particles, metal oxide, artificial diamond, graphite and the like, in the heat-resistant resin material such as polyimide (PI). Further, the sheet-like protective member is formed as a 10-30 μm thick parting layer of, e.g., the fluorine-containing resin material or formed of the fluorine-containing resin material alone in a sheet shape having the thickness of 30-100 μm.

Also in this embodiment, the relationship between the first drawing force F1 at the fixing nip N1 and the second drawing force F2 at the contact portion N2 is set at F1≧F2.

At the contact portion N2, the fixing roller 30 and the ceramic heater 15 are press-contacted while sliding on each other and therefore the drawing force in the case where the recording material P is nipped at the contact portion N2 is liable to be increased. However, the relationship of F1≧F2 is kept by changing the pressure, the material and the surface property with respect to the fixing roller 30.

Specifically, e.g., the pressure of the film 16 on the fixing roller 30 is made small so as to be 10% to 20% of the pressure of the pressing roller 17 on the fixing roller 30. Further, e.g., the sliding property is enhanced by changing the fluorine-containing resin material for the ceramic heater 15 slidably contacted to the fixing roller 30 into a blend resin material of PTFE and PFA. Further, into the fluorine-containing resin material, an inorganic filler such as graphite for enhancing the sliding property is dispersed.

In this way, by providing the drawing forces with the relationship of F1≧F2, during the jam clearance, the recording material P can be easily pulled out without tightening the fixing roller 30.

Fourth Embodiment

In this embodiment, a constitution using a heat roller 51 as the heating member will be described. Constituent elements similar to those described above are represented by the same reference numerals or symbols and will be omitted from description. FIG. 8 is a schematic sectional view showing a schematic structure of a fixing device in Fourth Embodiment.

Figure 9:
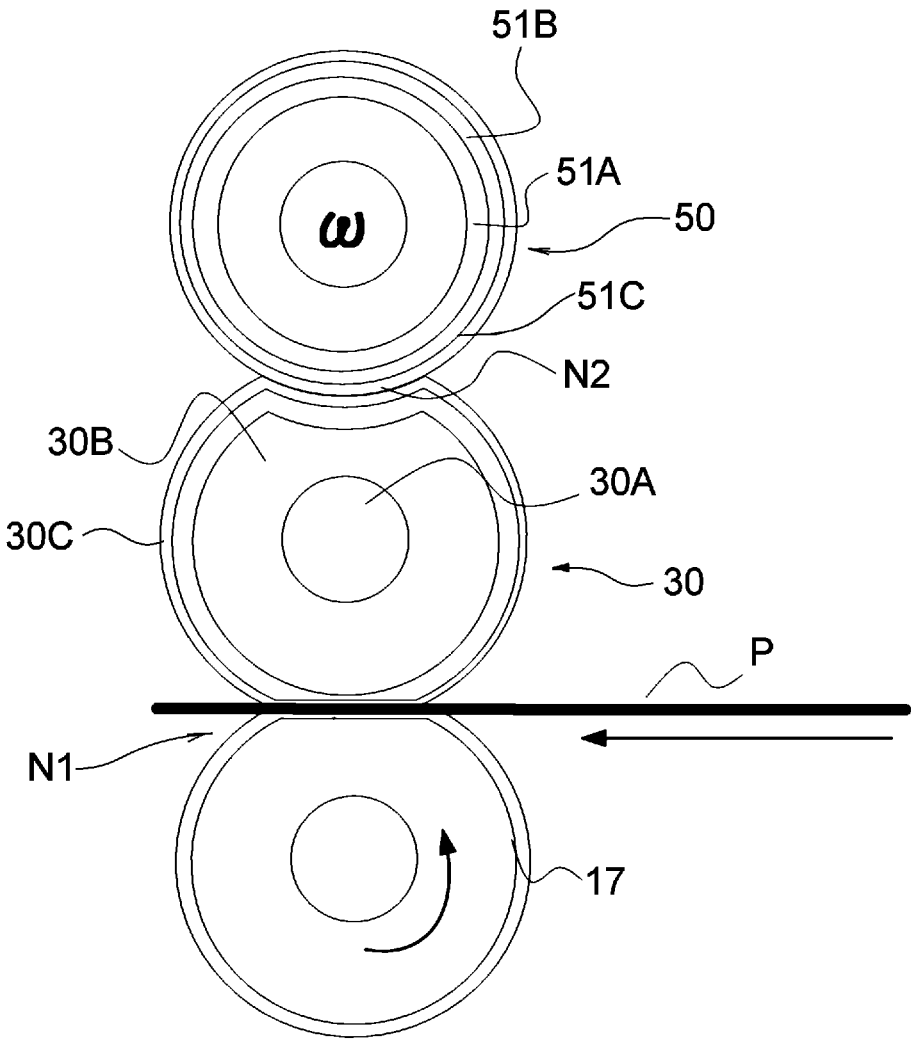

In this embodiment, as shown in FIG. 9, as the heating member for forming the contact portion N2 with the fixing roller 30, the heat roller 51 (press-contact member) containing a halogen heater 50 is used. The heat roller 51 is, e.g., a 0.3-3 mm thick hollow cylindrical member including a metal core 51A principally formed of SUS, iron, aluminum or the like. As the outermost layer of the heat roller 51, a parting layer 51C principally formed of the fluorine-containing resin material such as PTFE or PFA is provided.

Also in this embodiment, the relationship between the first drawing force F1 at the fixing nip N1 and the second drawing force F2 at the contact portion N2 is set at F1≧F2.

The adjustment of the drawing forces F1 and F2 is, e.g., performed by making the pressure of the heat roller 51 on the fixing roller 30 smaller than the pressure of the pressing roller 17 on the fixing roller 30. Further, e.g., the parting layer 51C of the heat roller 51 is formed of a blend resin material of PTFE and PFA, and the parting layer of the pressing roller 17 is formed of the PFA resin material. Further, into the fluorine-containing resin material of the parting layer 51C, an inorganic filler such as graphite for enhancing the sliding property is dispersed.

In this way, by providing the drawing forces with the relationship of F1≧F2, during the jam clearance, the recording material P can be easily pulled out without tightening the fixing roller 30.

Fifth Embodiment

In this embodiment, a constitution using a plate-like pressing member 96 as the pressing member will be described. Constituent elements similar to those described above are represented by the same reference numerals or symbols and will be omitted from description. FIG. 8 is a schematic sectional view showing a schematic structure of a fixing device in Fifth Embodiment.

Figure 10:
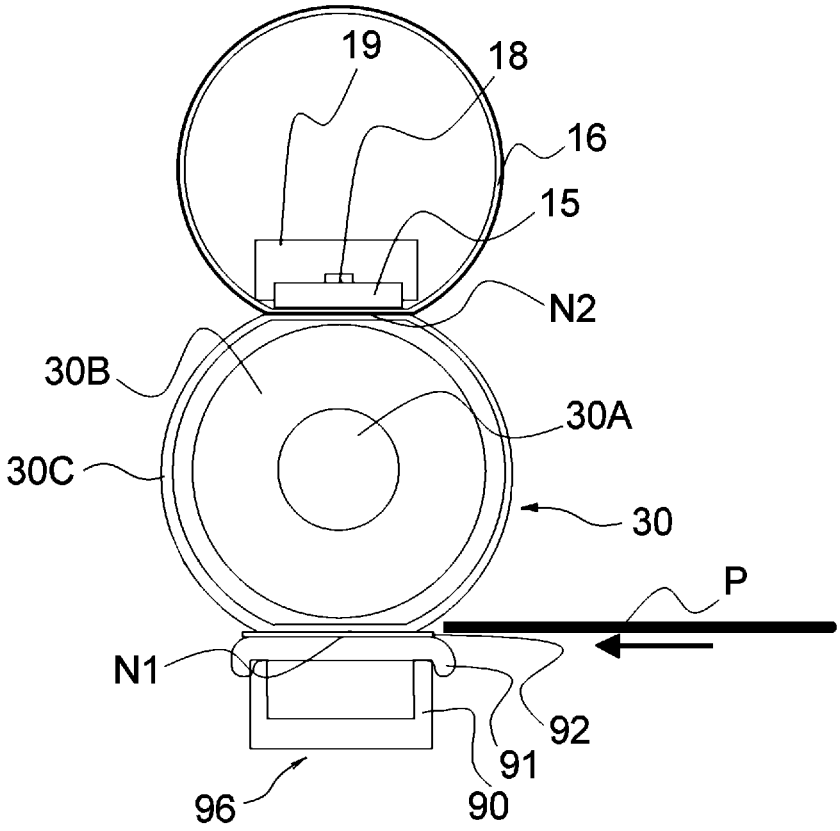

In this embodiment, as shown in FIG. 10, as the pressing member, the plate-like pressing member 96 to be slidably contacted to the fixing roller 30 is used. The plate-like pressing member 96 is, constituted by forming a heat insulating member or layer 91 on a supporting member of, e.g., SUS material and then by forming a sliding parting layer 92 on the heat insulating layer 91.

The sliding parting layer 92 of the plate-like pressing member 96 may preferably be formed of a material with an excellent sliding property so as not to prevent conveyance of the recording material P and may preferably be formed of a material having an excellent parting property so as to prevent the transferred toner to adhere to the fixing roller 30. For example, it is suitable that a sheet of the fluorine-containing resin material is formed as the sliding parting layer by bonding or coating.

In the fixing nip N1, the fixing roller 30 and the plate-like pressing member 96 are contacted while sliding on each other.

Also in this embodiment, the relationship between the first drawing force F1 at the fixing nip N1 and the second drawing force F2 at the contact portion N2 is set at F1≧F2.

In order to realize the above-described relationship between the drawing forces F1 and F2, e.g., the pressure of the film 16 on the fixing roller 30 is made smaller than the pressure of the pressing roller 17 on the fixing roller 30. Further, e.g., the surface of the film 16 is coated with a blend resin material of PTFE and PFA, and the surface of the plate-like pressing member is coated with the PFA resin material.

In this way, by providing the drawing forces with the relationship of F1≧F2, during the jam clearance, the recording material P can be easily pulled out without tightening the fixing roller 30.

Sixth Embodiment

In this embodiment, a constitution using a heat roller containing a halogen heater 50 as the fixing roller 30 will be described. Constituent elements similar to those described above are represented by the same reference numerals or symbols and will be omitted from description. FIG. 8 is a schematic sectional view showing a schematic structure of a fixing device in Sixth Embodiment.

Figure 11:
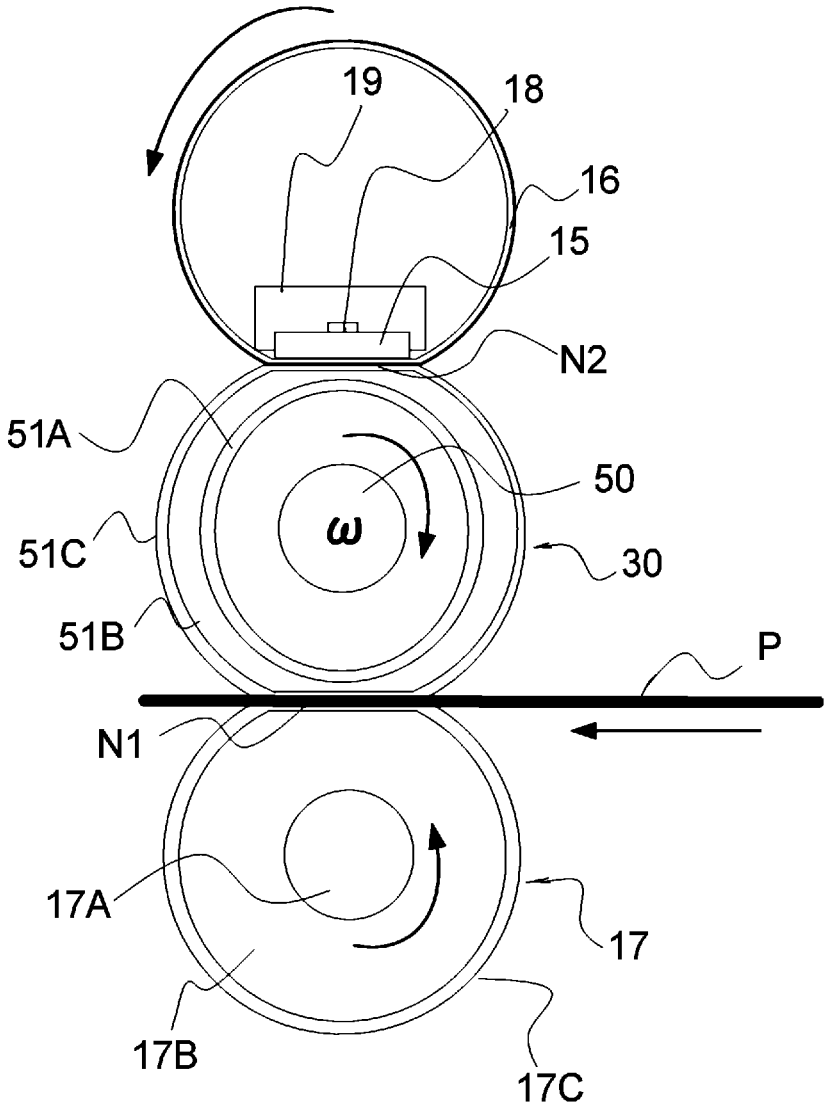

In this embodiment, shown in FIG. 11, the fixing roller 30 contains the halogen heater 50 and is internally and externally heated to shorten the warm-up time.

The fixing roller 30 is, e.g., a 0.3-3 mm thick hollow cylindrical member including a metal core 51A principally formed of SUS, iron, aluminum or the like. On the metal core 51A, an elastic layer 51B principally formed of the silicone rubber is provided. As the outermost layer of the heat roller 51, a parting layer 51C principally formed of the fluorine-containing resin material such as PTFE or PFA is provided.

Also in this embodiment, the relationship between the first drawing force F1 at the fixing nip N1 and the second drawing force F2 at the contact portion N2 is set at F1≧F2.

In order to realize the above-described relationship between the drawing forces F1 and F2, e.g., the pressure of the film 16 on the fixing roller 30 is made smaller than the pressure of the pressing roller 17 on the fixing roller 30. Further, e.g., the surface of the film 16 is coated with a blend resin material of PTFE and PFA, and the surface of the plate-like pressing member is coated with the PFA resin material.

In this way, by providing the drawing forces with the relationship of F1≧F2, during the jam clearance, the recording material P can be easily pulled out without tightening the fixing roller 30.

Seventh Embodiment

In this embodiment, a constitution in which the heating member is press-contacted to also the pressing roller 17 will be described. Constituent elements similar to those described above are represented by the same reference numerals or symbols and will be omitted from description. FIG. 8 is a schematic sectional view showing a schematic structure of a fixing device in Seventh Embodiment.

Figure 12:
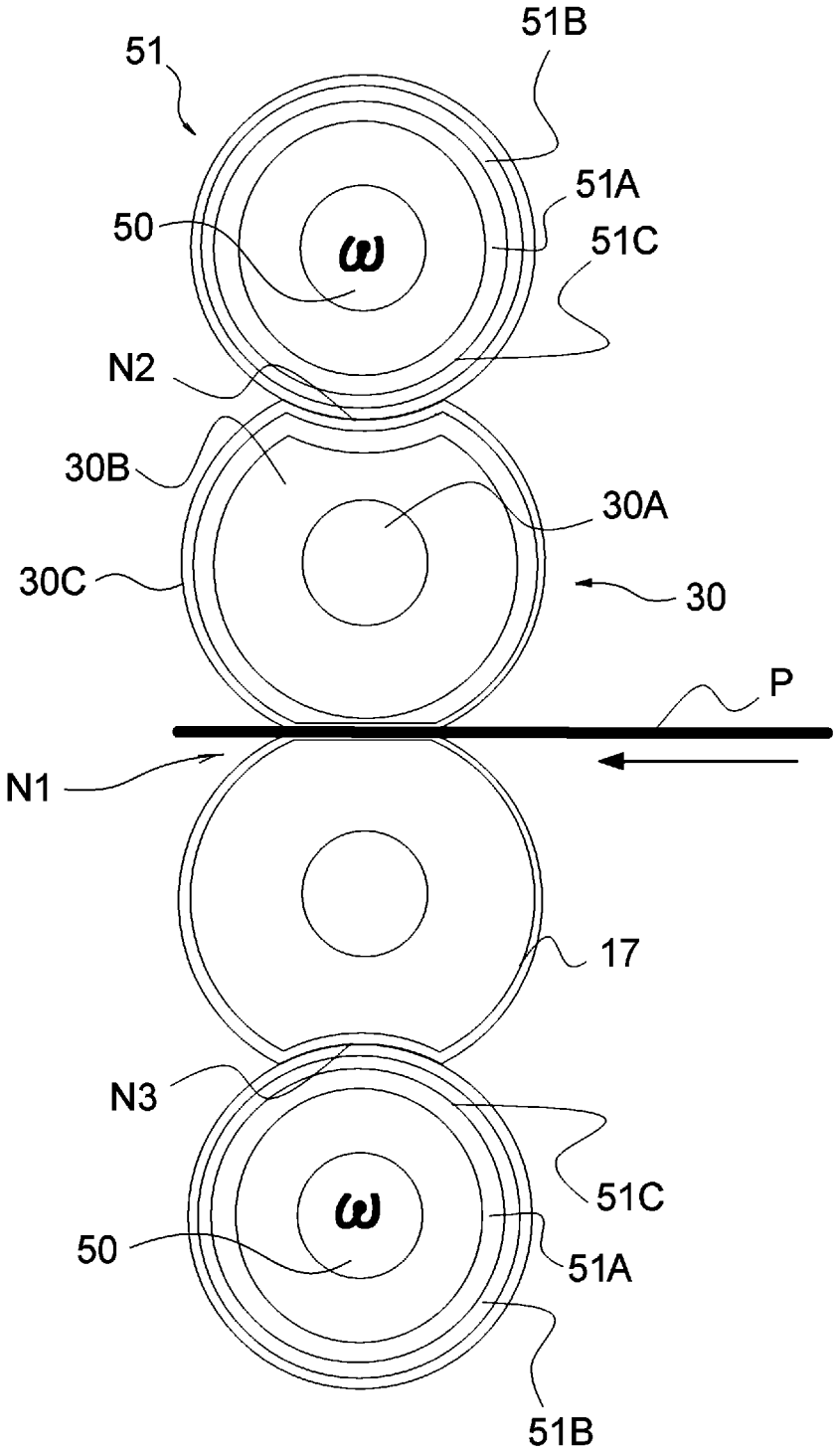

In this embodiment, as shown in FIG. 12, the heating member is press-contacted to also the pressing roller 17 to form a press-contact portion N3. In addition to the fixing roller 30, the pressing roller 17 is also externally heated, so that the warm-up time is further shortened. The heating member is the heat roller 51 containing the halogen heater 50.

Also in this embodiment, the relationship between the first drawing force F1 at the fixing nip N1 and the second drawing force F2 at the contact portion N2 is set at F1≧F2.

Further, the relationship between a third drawing force F2 at the press-contact portion N3 and the first drawing force F2 at the fixing nip N1 is set at F1≧F3.

In order to realize the above-described relationship between the drawing forces F1 and F2 and the relationship between the drawing forces F1 and F3, e.g., the pressure of the heat roller 51 on the fixing roller 30 and the pressure of the heat roller 51 on the pressing roller 17 are made smaller the pressure of the pressing roller 17 on the fixing roller 30. Further, e.g., the parting layer 51C of the heat roller 51 is formed of a blend resin material of PTFE and PFA, and the parting layers of the fixing roller 30 and the pressing roller 17 are formed of the PFA resin material. Further, into the fluorine-containing resin materials of the parting layers 51C of the heat rollers 51 an inorganic filler, such as graphite for enhancing the sliding property, is dispersed.

In this way, by providing the drawing forces F1 and F2 with the relationship of F1≧F2, during the jam clearance, the recording material P can be easily pulled out without tightening the fixing roller 30.

Further, by providing the drawing forces F1 and F3 with the relationship of F1≧F3, during the jam clearance, the recording material P wound about the fixing roller 17 can be easily pulled out.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 071466/2010 filed Mar. 26, 2010, which is hereby incorporated by reference.

What is claimed is:

1. A fixing device for fixing on a recording material a toner image formed on the recording material, said fixing device comprising:

a fixing roller;

a heating member configured to heat said fixing roller in contact with an outer surface of said fixing roller; and a pressing member configured to form a fixing nip between itself and said fixing roller, wherein the recording material on which the toner image is formed is subjected to fixing by being nipped and conveyed in the fixing nip, and wherein when the recording material which has been jammed is removed by pulling a trailing end of the recording material in a winding jam state in which a leading end of the recording material has passed through the fixing nip to reach a contact portion between said heating member and said fixing roller, a drawing force F1 for drawing the recording material, toward an upstream side of said fixing device with respect to a rotational direction of said fixing roller, nipped in the fixing nip between said fixing roller in a rest state and said pressing member and a drawing force F2 for drawing the recording material, toward the upstream side with respect to the rotational direction of said fixing roller, nipped between said fixing roller in the rest state and said heating member are set so that the drawing force F2 is not more than the drawing force F1 so as to prevent said fixing roller from being tightened by the recording material.

2. A fixing device for fixing on a recording material a toner image formed on the recording material, said fixing device comprising:

a fixing roller;

a heating member configured to heat said fixing roller in contact with an outer surface of said fixing roller; and a pressing member configured to form a fixing nip between itself and said fixing roller, wherein the recording material on which the toner image is formed is subjected to fixing by being nipped and conveyed in the fixing nip, and wherein a drawing force F1 for drawing the recording material, toward an upstream side of said fixing device with respect to a rotational direction of said fixing roller, nipped in the fixing nip between said fixing roller in a rest state and said pressing member and a drawing force F2 for drawing the recording material, toward the upstream side with respect to the rotational direction of said fixing roller, nipped between said fixing roller in the rest state and said heating member are set so that the drawing force F2 is not more than the drawing force F1 so as to prevent said fixing roller from being tightened by the recording material when the recording material which has been jammed is removed by pulling a trailing end of the recording material in a winding jam state in which a leading end of the recording material has passed through the fixing nip to reach a contact portion between said heating member and said fixing roller.

3. A fixing device according to claim 1 or 2, further comprising a first pressing mechanism configured to apply pressure to the fixing nip and a second pressing mechanism configured to apply pressure between said fixing roller and said heating member, wherein when the winding jam occurs, said first pressing mechanism and said second pressing mechanism are operated so as to form a pressed state in which the drawing force F1 and the drawing force F2 satisfy a relationship of: F1≧F2.

* * * * *